US005225813A

United States Patent [19]

Raub, Sr.

[11] Patent Number: 5,225,813

[45] Date of Patent: Jul. 6, 1993

[54] LIQUID FUEL OVERFLOW PREVENTION SYSTEM

[75] Inventor: James B. Raub, Sr., Linden, N.J.

[73] Assignee: Marine Power and Control, Inc., Piscataway, N.J.

[21] Appl. No.: 790,798

[22] Filed: Nov. 12, 1991

[51] Int. Cl.[5] ..... G08B 21/00

[52] U.S. Cl. ..... 340/623; 141/95; 137/423; 340/525; 340/691; 340/693

[58] Field of Search ..... 340/623, 618, 525, 524, 340/691, 693; 141/95, 198; 137/423, 409, 558

[56] References Cited

U.S. PATENT DOCUMENTS

| | | | |
|---|---|---|---|
| 4,117,479 | 9/1978 | Galvin et al. | 340/525 |
| 4,138,670 | 2/1979 | Schneider et al. | 340/693 |
| 4,251,813 | 2/1981 | Carre | 340/693 |
| 4,789,946 | 12/1988 | Sinz | 340/618 |
| 4,994,792 | 2/1991 | Ziegler, Jr. | 340/691 |
| 5,065,139 | 11/1991 | Shefsky | 340/618 |
| 5,066,944 | 11/1991 | Slocum | 340/618 |
| 5,111,188 | 5/1992 | Turloff et al. | 340/623 |
| 5,124,686 | 6/1992 | White et al. | 340/623 |
| 5,141,019 | 8/1992 | Le Blanc et al. | 137/423 |

*Primary Examiner*—Glen R. Swann, III

*Attorney, Agent, or Firm*—Caesar, Rivise, Bernstein, Cohen & Pokotilow, Ltd.

[57] ABSTRACT

A centrally controlled system for preventing overflow of fuels during loading operations includes dual processors either of which can take over the functions of the other processor when it fails. The system also includes full self-diagnostics and automatic testing to ensure that the warning lights and audible alarms at the loading compartments and the warning lights and audible alarms at the central location are operative during loading operations. If warning lights at the loading compartments are not visible due to obstructions, a voice synthesizer is used instead of lights at the loading compartments to announce the compartment identifier and the level of alarm reached. Floats in each compartment operate contacts when the level in the compartment reaches a first high level and when the level in the compartment reaches a second overfill level. In addition, if the level in any compartment reaches an overfill level, the power to the pumping station is automatically cut-off ceasing the loading operation.

61 Claims, 7 Drawing Sheets

32
OPTIONAL DECK MTD MINIATURE LAMP DISPLAYS
2
ZENER BARRIER
139
144
10
138
22
122
AMBER DECK LAMPS
126
132
18
PANEL MTD LAMPS
30
142
OPT. VOICE SYNTHESIZER
28
121
16
134
20
PANEL MTD CONTROLS
PANEL ALARM
DECK MTD ACKNOWLEDGE BUTTON
26
136
DECK ALARMS (VISUAL)
130
DECK ALARMS (AUDIBLE)
27
24
128
124
140
RED DECK LAMPS
62
MASTER RESET BUTTON
10
141
ZENER BARRIER

1.
START SCAN
2.
EXECUTE SELF DIAGNOSTICS
3.
SELF CHECK OK
NO
SET DIAGNOSTICS FAILURE BIT
YES
4.
MOVE ZEROS TO ONE-SHOT REGISTERS
5.
READ RELAY STATUS REGISTERS
6.
POWER LOSS RELAY CLOSED
NO
SET LOSS OF INPUT POWER BIT
YES
7.
OTHER PROCESSOR RUNNING RELAY CLOSED
NO
SET PROCESSOR FAILURE BIT
YES
8.
TEST/LOAD SELECTOR SW CLOSED
YES
CLEAR ONE-SHOT REGISTER
B
NO
A

LIQUID FUEL OVERFLOW PREVENTION SYSTEM

FIELD OF THE INVENTION

The present invention relates to overflow prevention systems and more particularly to an overflow prevention system for a liquid fuel barge or other vessel.

Recent increases in environmental concerns regarding oil and gasoline spills in our waterways and oceans have necessitated a new look at traditional methods of loading petroleum products onto floating conveyances. Originally, little regard was given to general safety or to potential environmental risks. Cargos of various petroleum distillates, such as gasoline were pumped aboard barges whose compartment hatches were left open. The bargeman observed the rising level of the product by peering down through open compartment hatches. This method was extremely dangerous. It not only exposed the bargeman to potential health risks because of the exposure to fumes, but it exposed the waterways to the potential hazards of overflowing and explosions.

New government mandates curbing these antiquated practices have recently been enacted. Petroleum products in general, and gasoline products in particular, can no longer be pumped aboard barges with open hatches. Utilization of totally closed tank filling systems is now required. The access hatches must be tightly secured during product loading and noxious fumes or vapors must be pumped out during the loading process by means of vapor collection manifolds. The recovered vapors must be piped ashore and processed through various methods to remove the hydrocarbons before the gases can be vented to the atmosphere.

Liquid levels must now be automatically sensed during loading by means of floats, sonar, or other devices. As a back-up, the observation of the product as it rises in the storage compartments may be viewed through sight glasses, but the compartments must remain tightly sealed. Also, there must be adequate valves and other devices to avert spills of the product to the seas or waterways and alarms with manual and automatic shutdown capability of pumping facilities.

The compartments for the holding of petroleum products are laid out symmetrically with respect to the keel of the vessel. Therefore, in most cases, the compartments are positioned longitudinally along the length of the ship in two rows, a line of compartments on the port side of the ship and another line of compartments on the starboard side of the ship. To maintain trim, the compartments must be loaded in a predetermined sequence.

In order to prevent overfill/overflow while loading, many systems use floats. There are two floats per compartment, a high level float and an overfill float. When the product in a compartment reaches a predetermined level, the rising high level float opens a pair of contacts which will cause an amber light on a single large "Scoreboard" at one end of the ship to be lit. If the product level continues to rise in the compartment, a second float will open a pair of contacts which will operate a red light on the scoreboard. In addition, the second overfill float has a pair of normally closed contacts which will open and automatically cut off power to the pumping station.

The "Scoreboard" or "Field Goal" approach utilizes a large display panel with a pair of lights for each compartment, i.e., an amber light for high level and a red light for the overfill level. The lights on the scoreboard are laid out in accordance with the location of the compartments of the ship in two rows, a port row and a starboard row of lights. When the level in any of the compartments exceeds its preset level, an alarm will sound and the bargeman observing the scoreboard is expected to immediately go to the compartment with the high level indication and operate a valve cutting off flow of further product into the compartment. Unfortunately, there is considerable delay and margin for error with this type of system. When the alarm sounds, the bargeman must observe the scoreboard, interpret its meaning, react and move to location of the fuel valve. Furthermore, existing systems do not have automated testing and self-diagnostics to ensure that every component of the warning and alarm system is operable prior to loading. A component failure could cause a spill, resulting in severe safety and environmental problems should overflow occur.

OBJECTS OF THE INVENTION

Accordingly, it is a general object of this invention to provide a liquid fuel overflow prevention system which overcomes the shortcomings of present systems.

It is a further object of this invention to provide a liquid fuel overflow prevention system which incorporates warning lights and alarms located at each loading compartment control valve.

It is yet a further object of this invention to provide a liquid fuel overflow prevention system with testing and self-diagnostics to assure full operability of the system during fuel loading.

It is still yet a further object of this invention to provide a liquid fuel overflow prevention system with a central equipment location for testing, monitoring, and controlling the operation of the system.

It is another object of this invention to provide a liquid fuel overflow prevention system with a display of the warning lights for every compartment at the central equipment.

It is yet another object of this invention to provide the liquid fuel overflow prevention system which incorporates multiple acknowledgment controls which indicate to the central equipment that action has been taken at a particular compartment during an alarm condition.

It is still yet another object of this invention to provide a liquid fuel overflow prevention system with a voice synthesizer which audibly identifies the compartment in which the fuel has reached alarm levels and the type of alarm level that has been reached.

It is an additional object of this invention to provide a liquid fuel overflow prevention system with an overall visual deck alarm when the fuel in any compartment has reached an alarm level.

It is yet an additional object of this invention to provide a liquid fuel overflow prevention system with a display at a central equipment location which has alarm lights simulating the conditions which exist at every loading compartment on the vessel.

It is still yet an additional object of this invention to provide a liquid fuel overflow prevention system that would automatically switch to battery power in the event of loss of generator power, thereby allowing the completion of loading with alarm protection.

SUMMARY OF THE INVENTION

These and other objects of this invention are achieved by providing a liquid fuel overflow prevention system for barges or other vessels which convey petroleum or more similar products. These vessels have a series of compartments into which the products are loaded from a pumping station. The compartments are arrayed on both sides of the ship in a longitudinal row and are filled in an ordered sequence so that the ship remains trim during the loading operation.

In order to prevent overflow, the system includes two floats with electrical contacts. When the product in any compartment reaches a first predetermined high level, the contacts of the first float will open causing an amber light at the compartment control valve to be lit. In addition, an audible alarm is sounded. When the liquid in any compartment reaches a second predetermined level, a normally closed contact will open causing a red light at the compartment to be lit. Also, the second float has a normally closed contact which opens when the overfill level is reached. The normally closed contacts of each compartment are wired in series with the control circuit in the pumping station so that if any second float in any compartment reaches the overfill level, the opening of its normally closed contacts will interrupt the control connection and automatically stop the pumping operation.

The system includes a centrally located display and control equipment which indicates the status o the alarm lights at each compartment and which tests and controls the operation of the overall system. The display has an array of the red and amber lights at each compartment which is laid out in accordance with the positioning of the compartments in two rows one on the port and a second on the starboard side of the ship. In addition to the alarm lights at the compartments and at the central equipment, audible alarms are used on the deck and at the central location to alert personnel that an alarm level has been reached at a particular compartment.

The system includes an acknowledgment button at each compartment control valve which signals the central equipment that appropriate action has been taken if an alarm has sounded. In addition to the audible and visual alarms at individual compartments, miniature visual deck alarm indicators may be employed. Also, a voice synthesizer can be used to announce the compartment identification and the alarm level which has occurred. The system has voltage surge protection circuitry and power back-up in case of a power outage. It also includes automated testing, diagnostic and manual testing capabilities as well as redundant logic processors at the central equipment location.

DESCRIPTION OF THE DRAWING

Other objects and many of the intended advantages of this invention will be readily appreciated when the same becomes better understood by reference to the following detailed description when considered in connection with the accompanying drawing wherein.

DETAILED DESCRIPTION OF THE PREFERRED EMBODIMENT

Figure 1A:
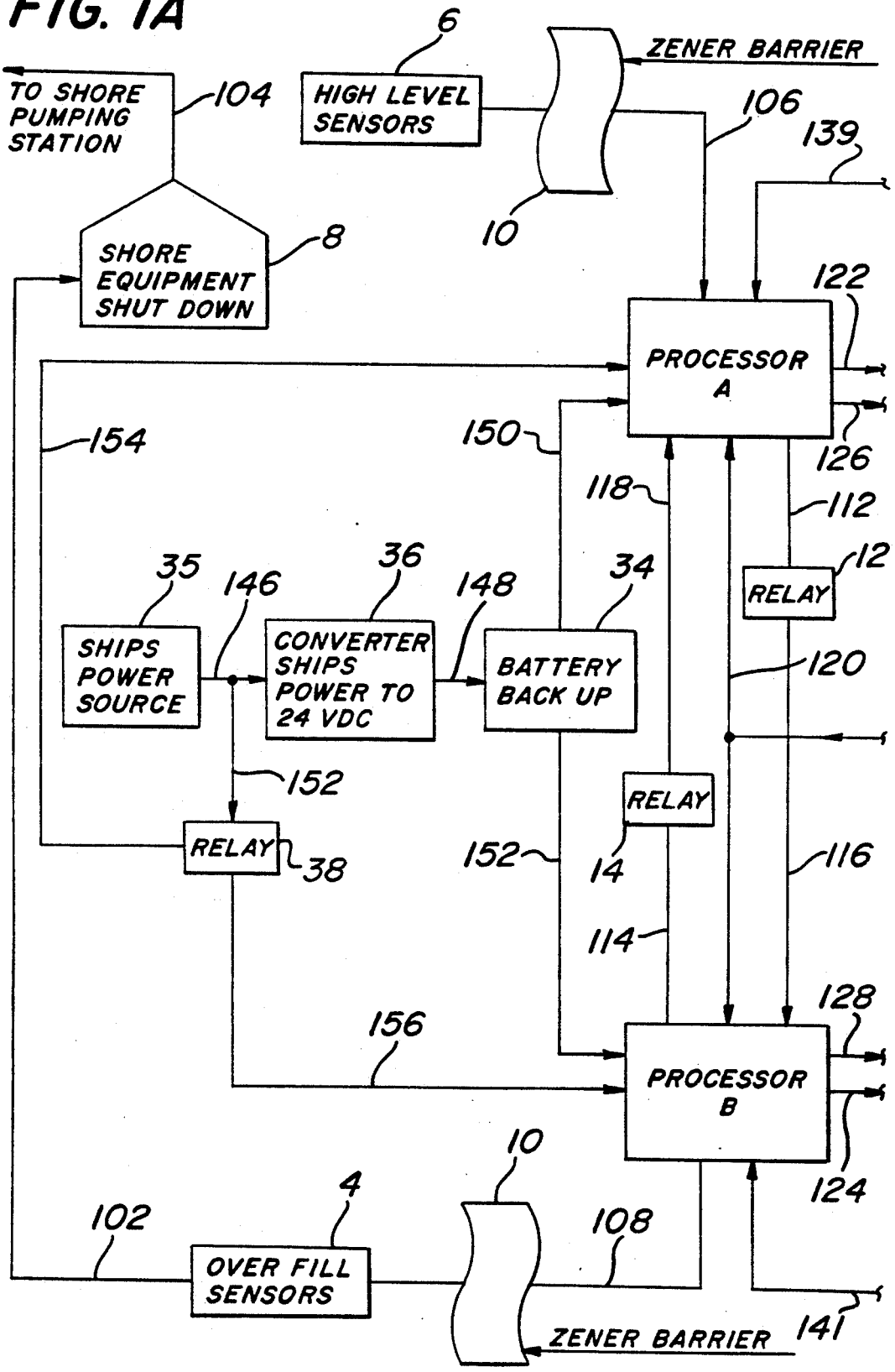
FIGS. 1A and 1B show a block diagram of the liquid fuel overflow protection system of the instant invention.
Figure 1B:
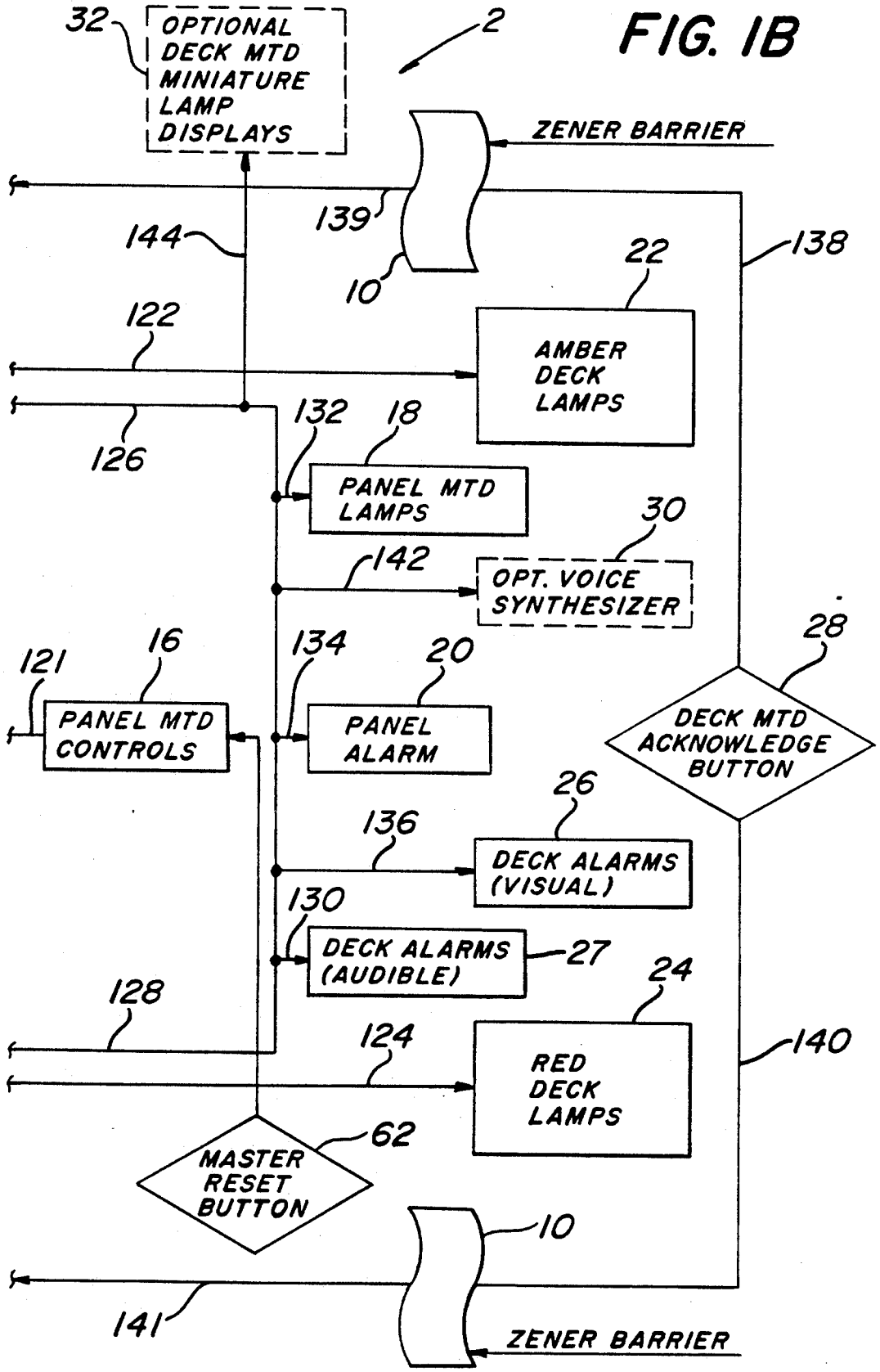

Referring now in greater detail to the various figures of the drawing, wherein like references and characters refer to like parts, a block diagram of the liquid fuel overflow prevention system 2 of the instant invention is shown in FIGS. 1A and 1B.

Overfill sensors 4 and high level sensors 6 are installed in each loading compartment of the ship. The level sensors 4 and 6 comprise floats which have contacts which operate when the liquid in a compartment reaches predetermined levels. The high level sensors 6 have normally closed contacts which open when the float rises to a predetermined high level. Typically, the contacts will be opened by the float when the level rises to within 12 inches of the top of the compartment. The float of the overfill sensors 4 has two sets of contacts. When the float rises to a predetermined overfill level, typically 6 inches from the top of the compartment, a pair of normally closed contacts open. In addition, when the overfill sensor 4 reaches the overfill level, a second pair of contacts, which are also normally closed, will open. The normally closed contacts of the overfill sensors 4 are wired in series so that if an overfill float in any compartment reaches the overfill level, the circuit will be broken. The contacts are connected to the shore equipment shutdown circuit 8 by lines 102, and from there to the shore pumping station on lines 104. The opening of any normally closed contacts in a compartment will result in an opening of the control connection at the shore pumping station thereby automatically stopping pumping of the fuel to the compartments.

The normally closed contacts of the high level sensor 6 are connected to processor A of the central display and control equipment by lines 106. Similarly, the normally closed contacts of the overfill sensors 4 are connected to processor B of the central control and display equipment by lines 108. Zener barriers 10 are connected between the normally closed contacts of the high level sensors 6 and the overfill sensors 4 and the processors A and B respectively. These zener barriers provide protection against voltage surges or spikes in the sensor system. They use zener diodes which breakdown at a predetermined voltage.

The central display and control equipment comprises the processors A and B, operating status relays 12 and 14, panel mounted controls 16, panel mounted lamps 18, a panel alarm 20, and relay 38, which senses power loss and reports to both processors.

Operating relay 12 is connected to processor A by line 112. The contacts of, the operating relay 12 are connected to processor B by line 116. Similarly, processor B is connected to operating relay 14 by line 114 and the contacts of operating relay 14 are connected to processor A by line 118.

As long as processors A and B are operable, the coils of operating relays 12 and 14 are energized and the contacts connected to processors A and B on lines 118 and 116 respectively, are closed. However, should either the processors A or B become inoperative, the contacts to the other processor are opened, signalling the other processor to take over the functions of the inoperative processor. Thus, processors serve as back-up to each other in emergency situations if one of the processors goes down. The functioning of the panel mounted controls 16, the panel mounted lamps 18, and the panel alarm 20 will be described in detail later.

When processor A has received a signal on line 106 that a high level sensor 6 has risen to its predetermined high level, the processor energizes an amber deck lamp 22 mounted at the respective compartment control valve via lines 122. Similarly, when the processor B receives a signal via lines 108 that one of the overfill sensors 4 has a reached its predetermined overfill level, it energizes a red deck lamp 24 at the respective compartment control valve via lines 124.

In addition, if either of the sensors 4 or 6 reaches its predetermined level, processors A and B energize audible deck alarms 27 via lines 126, 128, and 130 respectively. The audible deck alarms 27 sound a first tone when a high level sensor 6 rises to its predetermined high level and a second tone, which is distinguishable from the first tone, when an overfill sensor 4 rises to its predetermined overflow level. The associated panel mounted lamps (LED'S) of the central display and control equipment are operated from processors A and B on lines 126, 128 and 132 respectively Also, an audible alarm at the panel, panel alarm 20, is activated by processors A and B on lines 126, 128, and 134. Finally, visual deck alarms 26 are activated on lines 136 by processors A and B.

As stated previously, when an alarm goes off, a crewman is required to go to the appropriate compartment, where the high level has been detected, to turn off the valve preventing further flow into the compartment. When this is accomplished, the crewman depresses a deck mounted acknowledge button 28 located at that particular compartment. This signals processors A and B on lines 138, 139, 140 and 141 respectively, that the crewman has taken proper action at the alarm compartment. Again, to prevent dangerous build-ups caused by spikes or voltage surges, zener barriers 10 are installed between the acknowledge buttons and the processors.

The processors are controlled and tested by the panel mounted controls 16 which are connected to the processors A and B by lines 120 and 121 as will be explained later.

Optionally, in cases where deck lamps would not be visible to crewmen, a voice synthesizer 30 can be used. This synthesizer will announce the compartment identifier and the level of alarm which has occurred so that proper action can be taken on deck. The voice synthesizer 30 is connected to processors A and B by lines 126, 128 and 142. It has been found that crewmen best respond to a female voice message.

Another optional feature is the use of deck mounted miniature lamp displays 32 at each compartment which provide the array of lamps laid out to duplicate the location of the compartments on deck. The miniature lamp displays 32 are energized by the processors A and B via lines 144.

The system equipment is operated by 24 volts DC. The ships power source 35 is connected to convertor 36 which converts the ship's power to 24 volts DC. The output of the convertor 36 charges the back-up battery 34 by lines 148. The 24 volt DC is connected to processor A and B by lines 150 and 152 respectively. The output from the power source 35 is also connected to the power loss relay 38 by lines 152. When power is lost, the relay coil of 38 coil is de-energized, closing contacts which are connected to processors A and B via lines 154 and 156 respectively. This signals the processors to sound audible and visual power loss alarms. The processors automatically accept battery back-up power, as batteries float across processor power lines.

Figure 2:
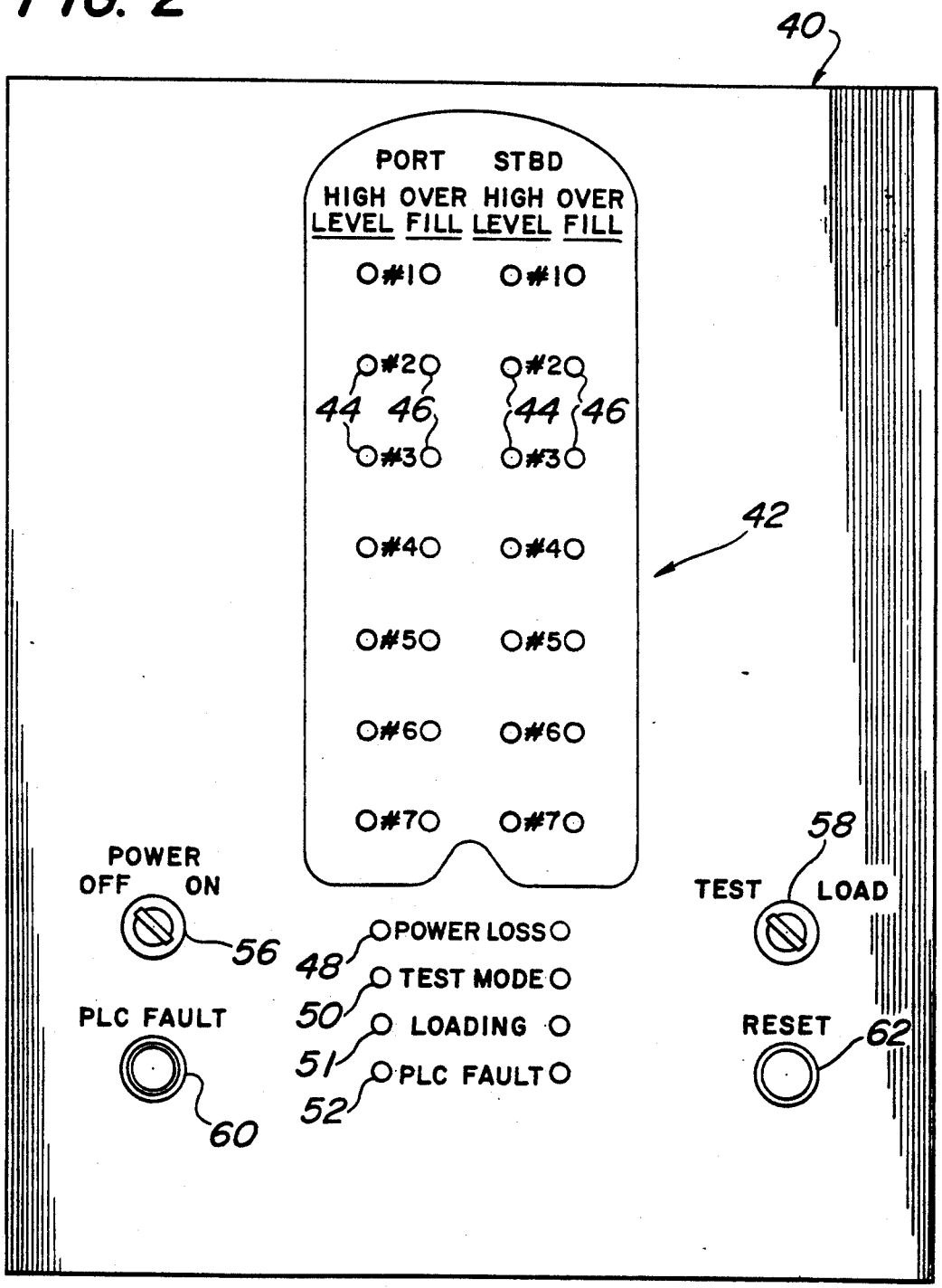
FIG. 2 shows the display and control panel of the central equipment of the system.

The display and control panel 40 of the central control and display equipment is shown in FIG. 2. The alarm lamps 18 are shown as an array to match this position of the compartments. The lamp display 42 is in the form of the outline of a tank barge with the left side indicated as port and the right side indicated as starboard. As can be seen in the display, this particular barge has 14 compartments, 7 compartments on the left or port side and 7 compartments on the right or starboard side. The amber deck lights 22 and the amber panel lights 44 are lit when the sensor 6 in the compartment detects a high level condition and the red deck lights 24 and the red panel lights 46 are lit when a sensor 4 detects an overfill condition.

Thus, if high level is detected in fifth compartment on the port side of the ship, the amber panel lamp 44 opposite No. 5 on the port side will be lit. Similarly, if an overfill condition is detected at the third compartment at the starboard side of the ship, the respective red panel light 46 will be lit.

Below the lamp array 42 display lamps 48 indicate power loss; lamps 50 indicate test in progress; lamps 51 show that loading is in process; and lamps 52 a fault in either of the processors (PLC'S) internal circuitry. At the upper left is power on/off control switch 56 and at the upper right is test/load switch 58. Device 60 is an audible alarm and reset button 62 resets the control equipment and lamps.

Testing and test procedure of the system will now be described. It is extremely important that the system be thoroughly tested prior to loading because failure of the system during loading of liquid fuels can result in disastrous spills and other dangerous conditions.

As will be described later, in the main scan loop of the processors A and B self-diagnostics are executed and diagnostic failures are detected. After the self-diagnostics, the relays which indicate whether there is a power loss or whether both processors are operating are then checked. If the contacts of the power loss relay 38 are open, the lamps 48 will light up indicating a power loss. Also, if the contacts of either of the two control relays 12 and 14 are open, the PLC fault lamps 52 will be lit and the audible PLC fourth alarm 60 will be sounded by the remaining processor. When the test/load switch 58 is switched to the test position the test subroutine is accessed.

At this time, the crewmen are instructed to manually lift levers positioned on the top of the compartments to raise the floats past the high level and overfill positions. This action will light the amber and red deck lamps at each compartment in turn and operate audible deck alarms and light the indicator lamps on the panel 40 at the central display equipment. Furthermore, the other visual deck alarms should operate. When the lever on a compartment is lowered, the lights will remain on or optionally they can be made to be reset when the lever lowered, but the audible alarm will go off. Thus, with completion of the lifting of the floats manually at each compartment all red and amber deck lamps should be lit, as well as all red and amber lamps at the panel 40. If the alternative voice synthesizer 30 is used, it announces the high level and overfill conditions at each of the compartments when the floats are lifted. Similarly, if the optional deck mount miniature lamp displays are used, the lamps should all light in turn until all lamps are lit on all such displays.

In addition to the self-diagnostics and testing described above, a deck lamp continuity circuit can be incorporated as an option. With this feature, resistors are placed in the circuits of each of the filaments and the voltage drop across the resistor operates opto-isolation circuits which send signals back to the central control and display equipment to check that a current is flowing through the filaments of the lamps.

In addition, automatic event recording including time and date of all occurrences during the testing and self-testing and during loading is stored within the processors A and B. Thus, periodically, an historical file is available by means of connecting a portable computer to each processor and downloading the information. This stored information can then be brought to a central computer which can print out all such occurrences. This serves as a check on the system which assures that testing is always performed prior to a loading and that all high level or overfill events which occur during loading have been reported to the authorities.

Figure 3:
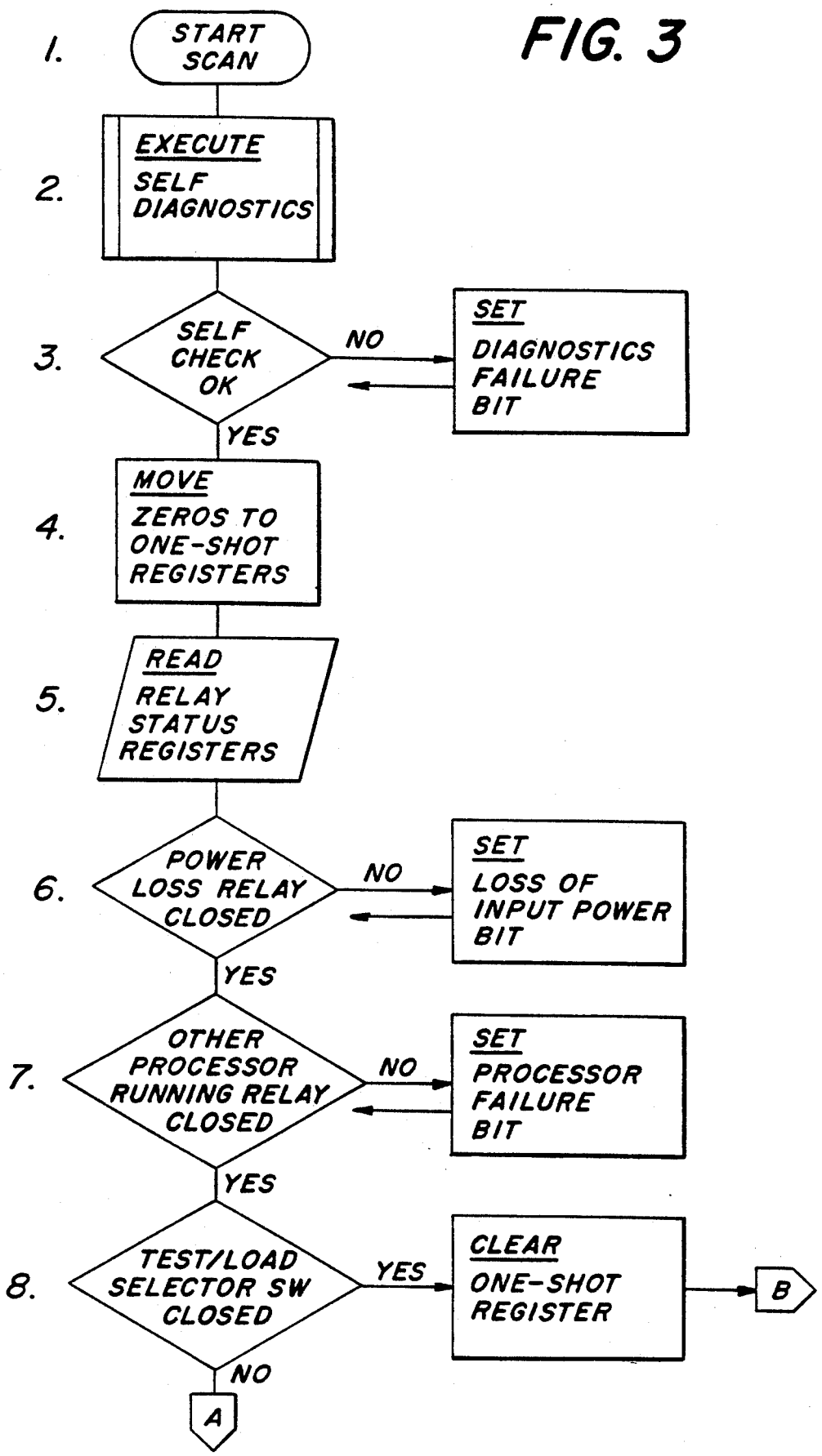
FIGS. 3 and 4 are flow charts of the program contained within each processor of the central equipment showing the main scan loop of the program.
Figure 4:
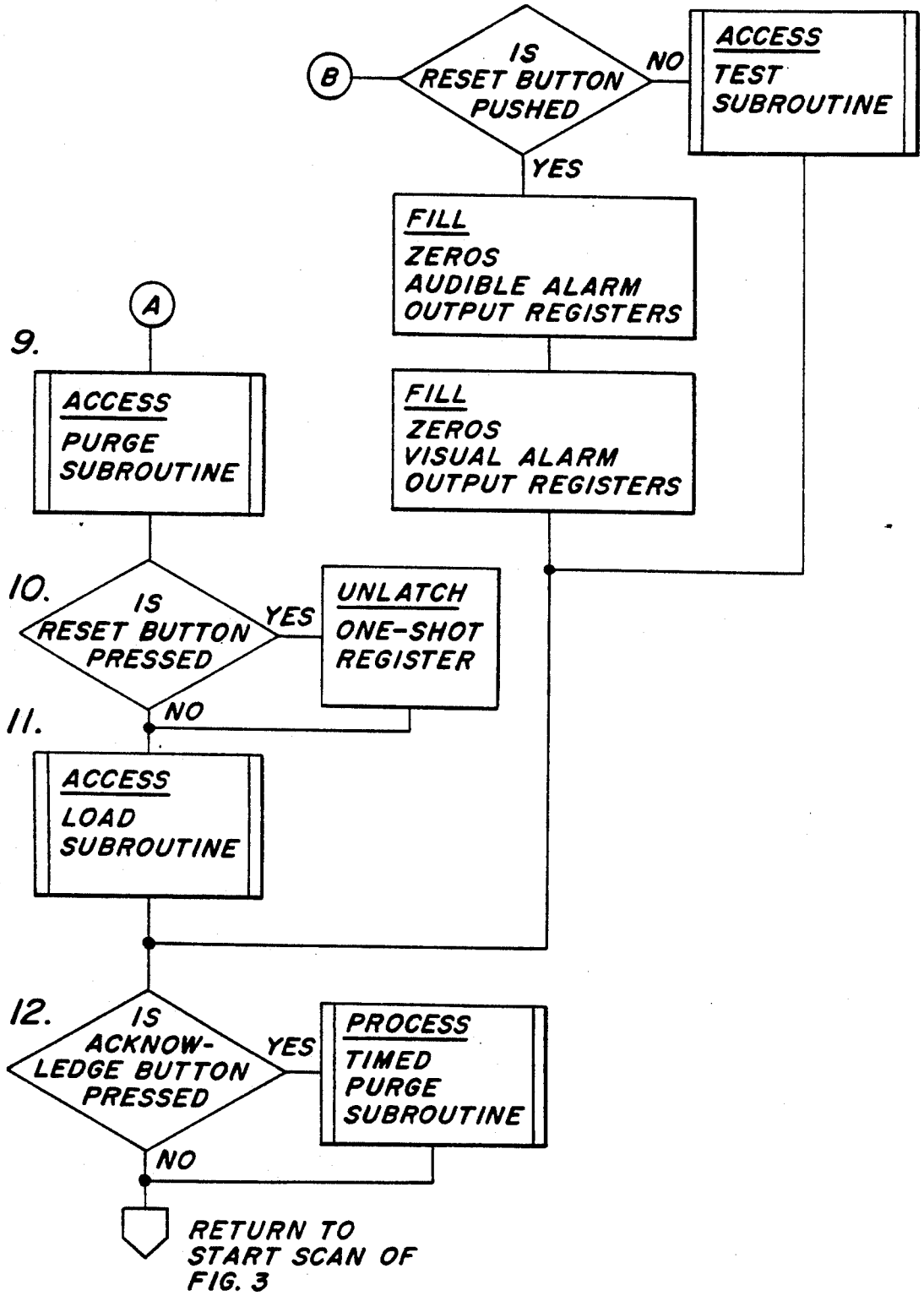

The program flow charts of the system are shown in FIGS. 3–8. FIGS. 3 and 4 describe the processors main scan loop. The processors start the scan after the power switch 56 is turned on. In step 2 the processors execute self-diagnostic routines. If the self-check is okay, as shown in step three, the processor places a zero on the one shot register (step 4) which clears that register. If the self-check of step 3 is not okay, a diagnostic failure bit is set to indicate an internal processor failure.

In step 5 the relay status registers are read which shows the disposition of the three system relays, the power loss relay 38 and the control relays 12 and 14. If the power loss relay contacts are not closed, step 6 the processor sets a loss of input power bit into a status register which energizes lamps 48 on the panel 40. If the control relays 12 or 14 is not closed, indicating that the other processor is not operating, a processor failure bit is set and lamps 52 are lit on the panel 40. If both the relays are closed, in step 8, the test/load switch is examined. If the test/load switch 58 is closed, i.e., the system is in the test position, the one shot register in the processor is re-cleared. The status of the reset button is then checked. If the reset button has been pushed, the processor fills zeros into the audible alarm output registers and fills zeros into the visual alarm output registers to reset all alarms. If the reset button has not been pushed, the test subroutine is accessed. This path then continues as path B on FIG. 4.

Figure 8:
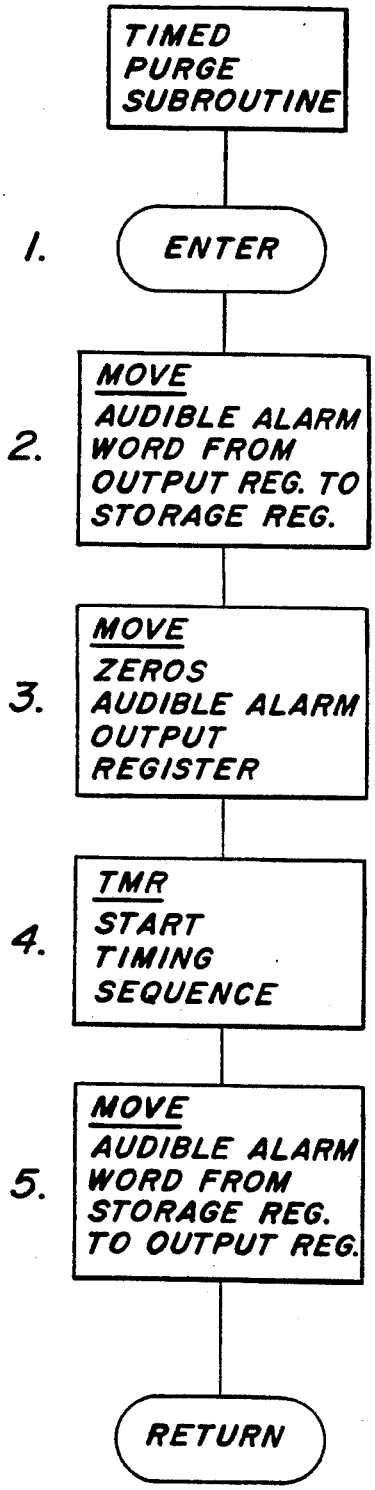
FIG. 8 is a program of the timed purge subroutine of the program.

If in step 8, the test/load selector switch is not closed, the processor accesses the purge subroutine and then continues on path A of FIG. 4. In path A, FIG. 4, if the reset button is pressed (step 10) the one shot register is unlatched and the processor accesses the load subroutine, step 11. If the reset button is not pressed, the load subroutine is directly accessed. The processor then proceeds to step 12 for both paths A and B and examines whether the acknowledge button has been pressed. If the acknowledge button has been pressed, the timed purge subroutine as shown in FIG. 8 is accessed. If the acknowledge button has not been pressed, the program returns to start scan at the top of FIG. 3.

Figure 5:
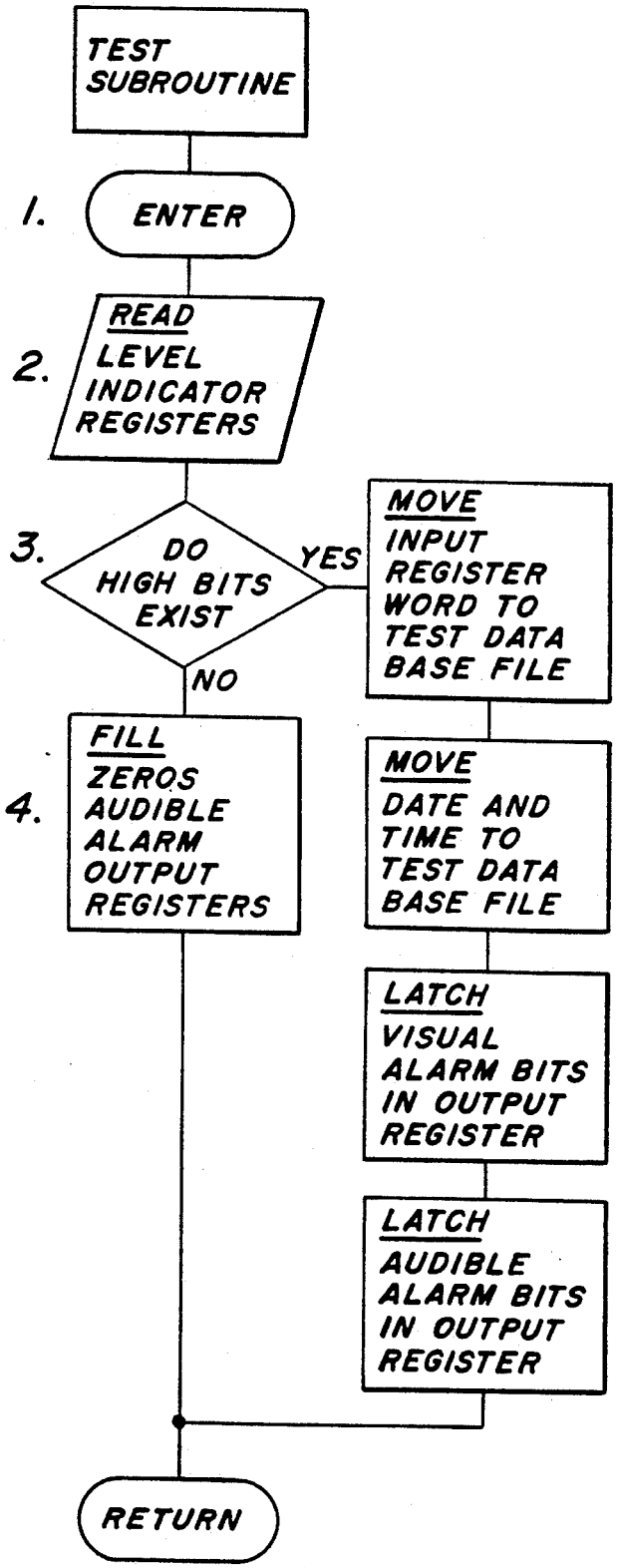
FIG. 5 is a flowchart of the test subroutine of the program.

The flowchart of the test subroutine is shown in FIG. 5. In step 1 the subroutine is entered and in step 2 the level indicator registers are read. Step 3 examines where the high bits and the level indicators are present. If they are, location data is moved to storage files, time and date data is moved to the storage files, the proper deck lamps are turned on and suitable audible alarms are turned on. If there are no high bits in the level indicator registers the audible alarms are turned off and program returns to the main scan loop of FIG. 3. Thus, during tests, when the floats are raised manually, the deck lamps remain on but the audible alarms are turned off.

Figure 6:
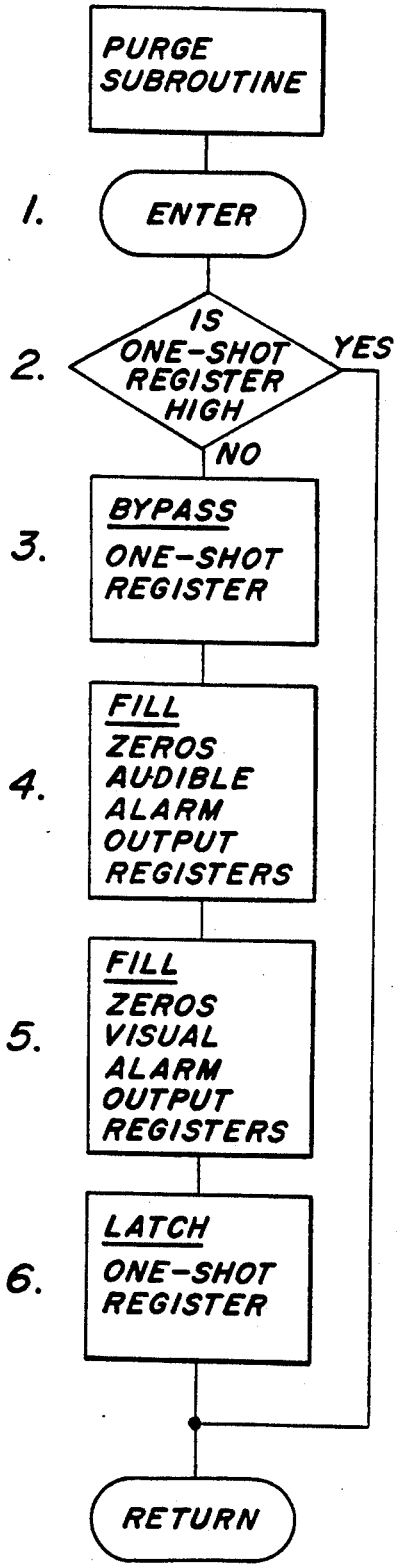
FIG. 6 is a flowchart of the purge subroutine of the program.

The flowchart of the purge subroutine is shown in FIG. 6. In step 1 the routine is entered. In step 2 the one shot register is examined. If the one shot register is high, the program returns to the main scan loop of FIG. 3. If the status of the one shot register is not high, the one shot register is bypassed and zeros are placed into the audible alarm output registers and the visual alarm output registers, turning them off. The one shot register is then latched which will ensure that a yes decision is made at step two of the next scan.

Figure 7:
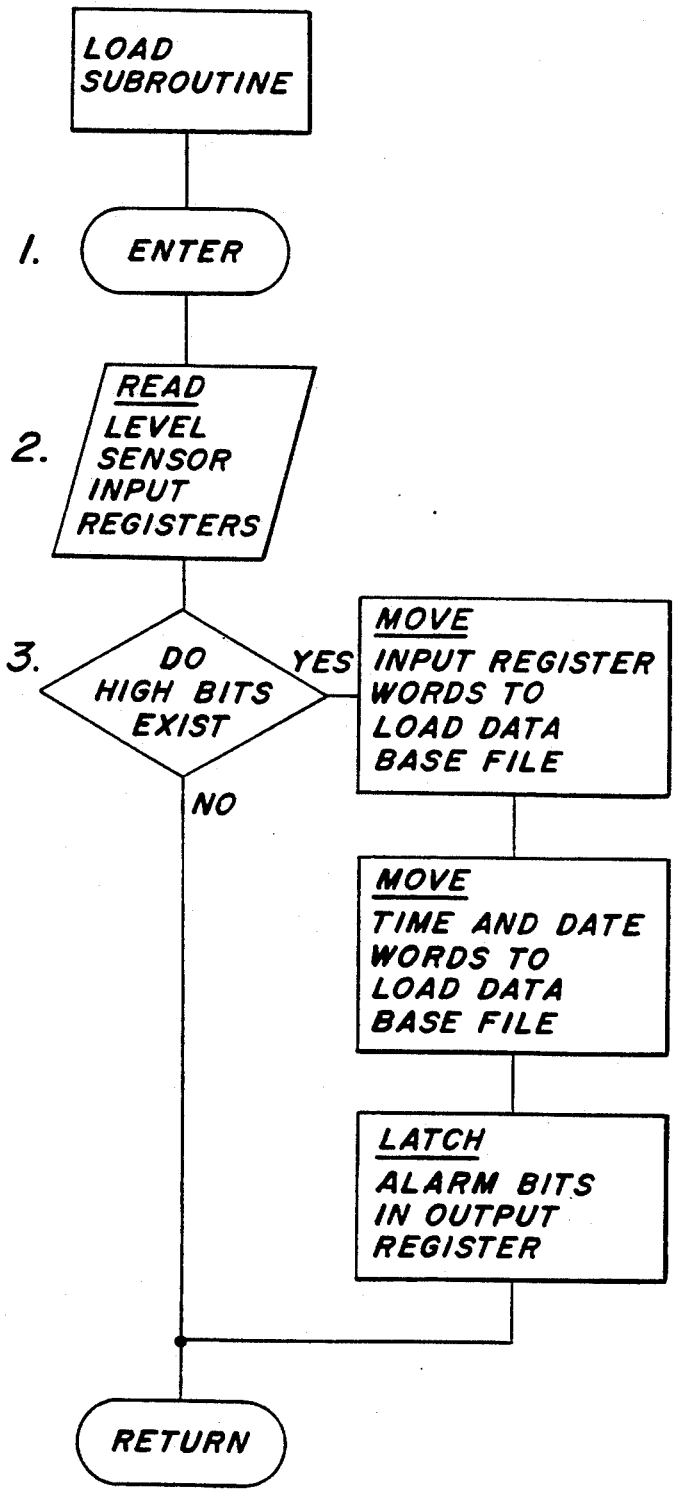
FIG. 7 is a flowchart of the load subroutine of the program.

The load subroutine flowchart is shown in FIG. 7. The subroutine is entered and the level sensor input registers are read. If high bits exist, (step 3), the processor moves the input register words to the data base file and then moves the time and date words to the data base file. As explained previously, the data base file can be loaded using a portable computer. The portable computer is then brought to a central remote computer for a printout and long-term storage of the data. The alarm bits are latched in the output register and the program returns to main scan loop of FIG. 3. If there are no high bits in the level sensor input register, i.e., there are no alarms present, the program returns to the main scan loop of FIG. 3. The main scan loop accesses the load subroutine (Step 11 of FIG. 4) each time it sequences through, unless the test switch 58 is in the test position.

In FIG. 8, the flowchart for the timed purge subroutine is given. After the subroutine is entered the processor moves the audible alarm word from the output register to the storage register which is a temporary file. In step 3, zeros are placed into the audible alarm output register stopping all audible alarms. The timing sequence is then started and after a predetermined number of seconds the data is retrieved from the temporary storage file and the audible alarm condition is reinstated. The program then returns to the main scan loop of FIG. 3. This is to ensure that corrective actions have been taken.

The system has been described which prevents overflow during the loading of liquid fuel into compartments on a barge or tanker ship. The system is centrally controlled and includes complete diagnostics and testing to assure that during loading operations the system will be fully operative. In addition to warning lamps and audible alarms at each of the compartments on deck, a central display and control panel repeats the warning lamps in an array which corresponds to the position of the compartments aboard this vessel.

Dual processors are used so that in case of the failure of one processor, the other processor can take over its functions. In addition, an automatic power outage detector will warn of power failure and provide battery back-up power. Alternatively, if the deck supports, pumps, masts, living quarters or other equipment are positioned so that the warning lamps at the compartment's valve stations cannot be seen, a voice synthesizer can be used. If an alarm level is reached at any of the compartments, the compartment identifier and the level of alarm is announced with a voice. In addition, when a warning lamp and audible alarms are operated on deck, the crewman must take action to close the valve at the indicated compartment to prevent overfill. When that action is completed, an acknowledge button is pressed at the associated valve station to indicate to equipment at the central location that the proper action has been taken.

Although the embodiment described herein discloses the use of the overflow protection system on a vessel, the system is equally applicable and effective for ocean going vessels, trucks, tank car trains, land based storage facilities, and the like.

Without further elaboration, the foregoing will so fully illustrate my invention that others may, by applying current or future knowledge, readily adapt the same for use under the various conditions of service.

What is claimed is:

1. A liquid fuel overflow protection system for a facility, said facility comprising a plurality of compartments for holding said fuel, said system comprising:

(a) at least one sensor at each one of said plurality of compartments for indicating the level of fuel in each of said compartments;

(b) at least one warning lamp at each of said plurality of compartments which operates when the level of fuel in a compartment reaches a predetermined level; and (c) central display and control equipment connected to said at least one sensor, said display and control equipment comprising;

(i) means for testing and diagnosing problems in said system;

(ii) means for displaying the operating status of said at least one warning lamp at each of said plurality of compartments on a display panel;

(iii) means for applying power and removing power from said system.

2. The system of claim 1 wherein said at least on sensor comprises a float with a set of contacts which open, causing electrical circuit to close when said float rises to a predetermined level.

3. The system of claim 2 wherein said at least one warning lamp comprises an electrical light which is energized when said contacts are opened..

4. The system of claim 3 wherein said system further includes an annunciator which sounds when said contacts of said float are opened.

5. The system of claim 4 wherein said system further includes a means to cut off the flow of said fuel when said float rises to said predetermined level.

6. The system of claim 5 wherein said float comprises a second set of normally closed contacts and said means to cut off said fuel flow comprises wiring said second set of contacts in each compartment in series and connecting said wiring to control connections to the pumps of a pumping station which is pumping said fuel into said compartments.

7. The system of claim 6 wherein said second set of normally closed contacts are opened when said float rises to said predetermined level thereby breaking said control connections to said pumps and cutting off the flow of said fuel.

8. The system of claim 7 wherein said first set of contacts are connected to said central display and control equipment and opening of said first recited set of contacts energizes an associated lamp at said central display and control equipment.

9. The system of claim 8 wherein said central display and control equipment is connected to said at least one warning lamp and energizes said at least one warning lamp at each of said compartments when said first set of contacts are opened.

10. The system of claim 1 wherein said at least one sensor comprises a first and a second sensor located at each of said plurality of compartments.

11. The system of claim 10 wherein said first sensor comprises a first float and said second sensor comprises a second float.

12. The system of claim 11 wherein said first float comprises a first set of normally closed contacts which open when said first float rises to a first level and wherein said second float comprises two sets of contacts, a second set of normally closed contacts which open when said second float rises to a second level, and a third set of normally closed contacts which open when said second float rises to said second level.

13. The system of claim 12 wherein said at least one warning lamp comprises a first and a second warning lamp at each of said compartments and the opening of said first set of said normally closed contacts lights said first warning lamp at each of said compartments and the opening of said second set of normally closed contacts of said second float lights said second warning lamp at each of said compartments.

14. The system of claim 13 wherein said first warning lamp is of a different color than said second warning lamp.

15. The system of claim 14 wherein said first warning lamp is amber and wherein said second warning lamp is red.

16. The system of claim 15 wherein said system further comprises an annunciator which sounds a first tone when said first float rises to said first level and a second tone, which is distinguishable from said first tone, when said second float rises to said second level.

17. The system of claim 16 wherein said display and control equipment comprises a display with third and fourth lamps for each of said plurality of compartments which are lighted when said first float rises to said first level and said second float rises to said second level respectively.

18. The system of claim 17 wherein said third and fourth lamps are positioned in an array on said display which corresponds to the locations of said plurality of compartments on said vessel.

19. The system of claim 18 wherein said system further comprises miniature displays which, with said first and second warning lights, are positioned in an array which corresponds to the locations of said plurality of compartments in said vessel.

20. The system of claim 1 wherein said central display and control equipment further comprises dual processors.

21. The system of claim 20 wherein said central display and control equipment comprises a means for detecting the operating condition of each of said dual processors and means for switching the full operation of said system to one of said dual processors when the other processor is not operating.

22. The system of claim 21 wherein said system further comprises back-up power means.

23. The system of claim 22 wherein said system further comprises means to detect the failure of the power source of said facility and means for automatically switching to said back-up power means for powering said dual processors when said failure is detected.

24. The system of claim 23 wherein said system further includes an audible alarm at each of said plurality of compartments which is sounded when the level of fuel in a respective compartment reaches said predetermined level.

25. The system of claim 24 wherein said means for testing and diagnosing problems further comprises means for manually operating said at least one sensor to operate said at least one warning lamp and to sound said audible alarm.

26. The system of claim 25 wherein said means for testing and diagnosing problems comprises a self-diagnostic test routine for said dual processors.

27. The system of claim 26 wherein said at least one sensor comprises a first and a second sensor located at each of said plurality of compartments.

28. The system of claim 27 wherein said first sensor comprises a first float and said second sensor comprises a second float.

29. The system of claim 28 wherein said first float comprises a first set of normally closed contacts which open when said first float rises to a first level and wherein said second float comprises two sets of contacts, a second set of normally closed contacts which open when said second float rises to a second level, and a third set of normally closed contacts which open when said second float rises to said second level.

30. The system of claim 29 wherein said at least one warning lamp comprises a first and a second warning lamp at each of said compartments and the opening of said first set of normally closed contacts lights said first warning lamp at each of said compartments and the opening of the second set of normally closed contacts of said second float lights said second warning lamp.

31. The system of claim 30 wherein said first warning lamp is of a different color than said second warning lamp.

32. The system of claim 31 wherein said first warning lamp is amber and wherein said warning lamp is red.

33. The system of claim 32 wherein said system further comprises an annunciator which sounds a first tone when said first float rises to said first level and a second tone, which is distinguishable from said first tone, when said second float rises to said second level.

34. The system of claim 33 wherein said central display and control equipment comprises a display with a third and fourth lamp for each of said plurality of compartments which are lighted when said first float rises to said first level and said second float rises to said second level respectively.

35. The system of claim 34 wherein third and fourth lamps are positioned in an array on said display which corresponds to the locations of said plurality of compartments on said vessel.

36. The system of claim 35 wherein said system further comprises miniature displays which, with said first and second warning lights, are positioned in an array which corresponds to the locations of said plurality of compartments in said vessel.

37. The system of claim 1 wherein said system further comprises means for checking the continuity of filaments of said at least one warning lamp.

38. The system of claim 1 wherein said system further comprises means for recording and storing information including the time, date, and nature of events which occur during testing, diagnostics, and loading operations.

39. The system of claim 38 wherein said system further comprises means for off-loading said information to a portable computer for later analysis and printout at a central computer.

40. A liquid fuel overflow protection system for a facility, said facility comprising a plurality of compartments for holding said fuel, said system comprising:

(a) a first and second sensor at each one of said plurality of compartments for indicating the level of fuel in each of said compartments;

(b) a first and a second warning lamp at each of said plurality of compartments, means to light said first warning lamp when the level of fuel in a compartment reaches a first predetermined level and means to light said second warning lamp when the level of fuel in said compartment reaches a second predetermined level; and (c) central display and control equipment connected to said first and second sensors, said display and control equipment comprising;

(i) means for testing and diagnosing problems in said system;

(ii) means for displaying the operating status of said lamps at each of said plurality of compartments on a display panel;

(iii) means for applying power and removing power from said system.

41. The system of claim 40 wherein said system further comprises an audible alarm, which operates in response to signals from said sensors, at each of said plurality of compartments.

42. The system of claim 41 wherein said first sensor comprises a first float and said second sensor comprises a second float.

43. The system of claim 42 wherein said first float comprises a first set of normally closed contacts which open when said first float rises to a first level and wherein said second float comprises two sets of contacts, a second set of normally closed contacts which open when said second float rises to a second level, and a third set of normally closed contacts which open when said float rises to said second level.

44. The system of claim 43 wherein said system further comprises means to cut off the flow of said fuel into said compartments when said level of fuel in any of said compartments reaches said second predetermined level.

45. The system of claim 44 wherein the opening of said first set of normally closed contacts lights said first warning lamp, and the opening of said second set of contacts lights said second warning lamp.

46. The system of claim 45 wherein said first warning lamp is of a different color than said second warning lamp.

47. The system of claim 46 wherein said first warning lamp is amber and wherein said second, warning lamp is red.

48. The system of claim 47 wherein said audible alarm comprises an annunciator which sounds a first tone when said first float rises to said first level and a second tone, which is distinguishable from said first tone, when said second float rises to said second level.

49. The system of claim 48 wherein said display and control equipment comprises a display with a third and fourth warning lamp for each of said plurality of compartments which are lit when said first float rises to said first level and said second float rises to said second level respectively.

50. The system of claim 49 wherein third and fourth lamps are positioned in an array on said display which corresponds to the locations of said plurality of compartments on said vessel.

51. The system of claim 50 wherein said system further comprises miniature displays which with said first and second warning lights positioned at each of said plurality of compartments in an array which corresponds to the locations of said plurality of compartments in said vessel.

52. The system of claim 51 wherein said central display and control equipment further comprises dual processors.

53. The system of claim 52 wherein said central display and control equipment comprises a means for detecting the operating condition of each of said dual processors and means for switching the full operation of said system to one of said dual processors when the other processor is not operating.

54. The system of claim 52 wherein said system further comprises back-up power means.

55. The system of claim 54 wherein said means for testing and diagnosing problems further comprises means for manually operating said first and second floats to light said first, second, third and fourth warning lamps and to sound said audible alarms.

56. The system of claim 55 wherein said means for testing and diagnosing problems comprises a self-diagnostic test routine for said dual processors.

57. The system of claim 40 wherein said system further comprises means for checking the continuity of the filaments of said first and second warning lamps.

58. The system of claim 40 wherein said system further comprises means for recording and storing information including the time, date, and nature of events which occur during testing, diagnostics, and loading operations.

59. The system of claim 58 wherein said system further comprises means for off-loading said information to a hand-held processor for later analysis and printout at a central computer.

60. A liquid fuel overflow protection system for a facility, said facility comprising a plurality of compartments for holding said fuel, said system comprising:

(a) a first and second sensor at each one of said plurality of compartments for indicating via lamps the level of fuel in each of said compartments;

(b) a voice synthesizer which announces the identification of the compartment and the level reached when the level of fuel in any of said plurality of compartments reaches a first predetermined level or a second predetermined level; and (c) central display and control equipment connected to said first and second sensors, said display and control equipment comprising;

(i) means for testing and diagnosing problems in said system;

(ii) means for displaying the operating status of said lamps at each of said plurality of compartments on a display panel;

(iii) means for applying power and removing power from said system.

61. The system of claim 60 wherein said voice synthesizer broadcasts a female voice.

* * * * *